US006429827B1

(12) United States Patent
Hsueh et al.

(10) Patent No.: US 6,429,827 B1
(45) Date of Patent: Aug. 6, 2002

(54) INTEGRATED MMDS ANTENNA WITH REFLECTOR MOUNTED ON A TOTALLY SEALED SINGLE-BODY DIPOLE-TRANSCEIVER BASE

(75) Inventors: Chien-Ping Hsueh, Hsinchu; Shun-Yu Chien, Bade; Yung-Li Huang, Taoyuan Hsien; Ching-Yen Hsiao, Changhwa Hsien; Tai-Mo Wang, Hsinchu, all of (TW)

(73) Assignee: Transystem, Inc., Hsinchu (TW)

( * ) Notice: Subject to any disclaimer, the term of this patent is extended or adjusted under 35 U.S.C. 154(b) by 0 days.

(21) Appl. No.: 09/519,439

(22) Filed: Mar. 3, 2000

Related U.S. Application Data

(63) Continuation-in-part of application No. 09/222,438, filed on Dec. 28, 1998.

(51) Int. Cl.[7] ..... H01Q 1/32
(52) U.S. Cl. ..... 343/820; 343/702
(58) Field of Search ..... 343/820, 872, 343/702, 718, 719, 873

(56) References Cited

U.S. PATENT DOCUMENTS 5,568,157 A * 10/1996 Anderson ..... 343/713
5,835,128 A * 11/1998 MacDonald et al. ..... 348/8
5,982,336 A * 11/1999 Wen et al. ..... 343/793

* cited by examiner

*Primary Examiner*—Don Wong
*Assistant Examiner*—James Clinger
(74) *Attorney, Agent, or Firm*—Bo-In Lin

(57) ABSTRACT

The present invention discloses an integrated single-body antenna-transceiver assembly for a multi-channel multi-point distribution system (MMDS) transceiver for bi-directional signal transmission and reception. The assembly comprises a dipole antenna-body comprising a surrounded plastic-molded exterior with interior metal dipole antenna extending vertically from a metal attachment-seat surrounding a signal feed pin connected to the dipole antenna. The assembly further comprises an MMDS transceiver having a transmitter printed circuit board (PCB) and a receiver PCB enclosed in a waterproof-metal housing having an antenna-attachment pad including a signal feed pin opening. The dipole antenna-body is securely attached to the waterproof-metal housing by attaching to the antenna-attachment pad sealed with an O-ring with the signal feed pin extended through the signal feed pin opening to contact the receiver PCB, the diplexer, and the transmitter PCB. In a preferred embodiment, metal housing for enclosing the transceiver further includes mounting means for securely mounting a reflector thereon. In another preferred embodiment, the metal housing for enclosing the transceiver further includes two types of mounting means corresponding with either horizontal or vertical signal polarization for several types of reflectors thereon.

28 Claims, 8 Drawing Sheets

IN HORIZONTAL MODE

IN VERTICAL MODE

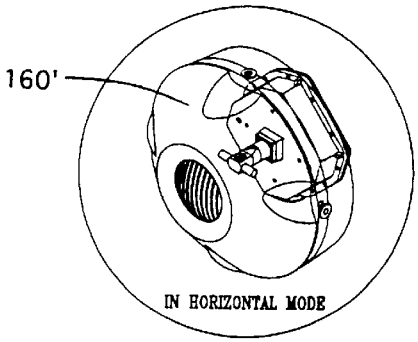
FIG. 7A
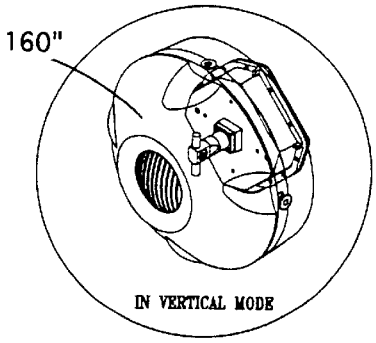
FIG. 7B
IN HORIZONTAL MODE →
FIG. 8A
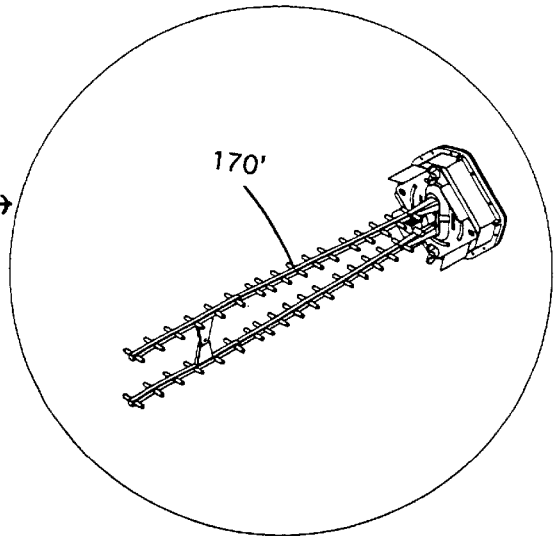
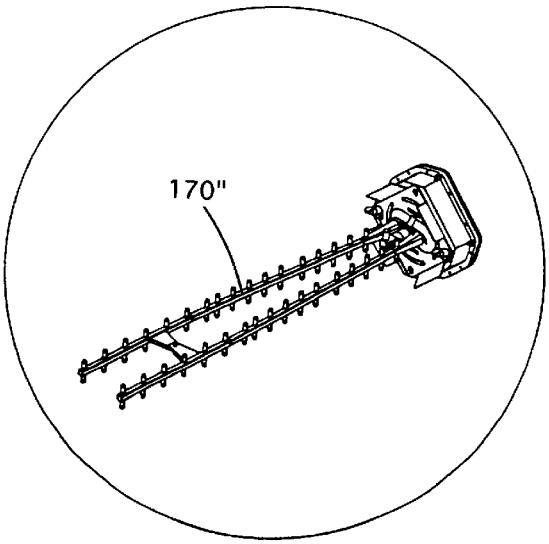
← IN VERTICAL MODE
FIG. 8B

INTEGRATED MMDS ANTENNA WITH REFLECTOR MOUNTED ON A TOTALLY SEALED SINGLE-BODY DIPOLE-TRANSCEIVER BASE

This Application is a Continuation-in-Part Application (CIP) of a Pending application Ser. No. 09/222,438 filed on Dec. 28, 1998 by common inventors of this Application and assigned to the same Assignee.

BACKGROUND OF THE INVENTION

1. Field of the Invention

This invention relates generally to a configuration and method for manufacturing a multi-channel multi-point distribution system (MMDS) transceiver for transmitting and receiving analog and digital signals. More particularly, this invention relates to a new and improved structure and method for simplifying the assembling procedure for manufacturing an MMDS transceiver integrated with a dipole antenna as a single-body unit and configured for conveniently and flexibly mounting multiple types of antenna reflectors onto the dipole antenna.

2. Description of the Prior Art

Conventional antennas for the MMDS transceivers are limited by the technical difficulties that practical configurations for reducing the transmission loss cannot conveniently achievable. The transmission loss of signals at higher frequencies often become quite significant at the connection between the antenna and the electronic circuits employed for frequency conversions and amplitude amplifications. Integrating the antenna and the electronic circuit as a single-unit by feeding the signals received from the antenna directly to the printed circuit board (PCB) supported the electronic circuits can eliminate the transmission loss. However, such integration often causes another difficulty that cannot be resolved by those of ordinary skill in the art of MMDS antenna design and manufacture. Specific difficulties often arise from the problems that an antenna when placed in an outdoor environment if integrated with electronic circuits as a single-unit often exposes the electronic circuits to the outdoor moist and dust. The conventional structure of antenna and the electronic circuits supported on a PCB does not provide a completely sealed space for the electronic circuits. Therefore, an antenna for the MMDS transceiver when exposed to an outdoor weather for an extended period of time becomes unreliable because the outdoor moisture and dust come into the housing contains the electronic circuits. For those of ordinary skill in the art, it is still a technical challenge to provide a reliable sealed environment for long term outdoor protection for the circuits employed to process the antenna signals for an MMDS transceiver.

The design of the MMDS transceiver typically involves a feed antenna connected to a bidirectional converter via a communication link. As Hemmie et al. disclose in U.S. Pat. No. 5,437,052 (issued Jul. 25, 1995), entitled "MMDS over the Air Bi-directional TV/Data Transmission System and Method Therefor", a standard configuration shown in FIG. 1. The details of these illustration are fully disclosed and explained in U.S. Pat. No. 5,437,052 that is now incorporated by reference here as part of the disclosure here in this Application for illustrating the state of the art in antennas for the MMDS transceivers. Since the drawings and the descriptions are included in this referenced Patent, the details numeral designations, the descriptions will not be repeated here in this present Application again. As shown in FIG. 2, there is coaxial cable connection between the antenna and the bidirectional converter and transmission loss often occurs in the cable connection. As explained in the Patent Application, the bidirectional converter could be located in the support boom and directly coupled to the feed line 84 thereby eliminating the need of a coaxial connection 210 altogether. However, it should be noticed that there is a vulnerable metal-penetration-into-plastic interface where the metal feed line 84 penetrate through the sealed enclosure to contact the bi-directional converter 100. Because of the concerns that the vulnerable metal-penetration-to plastic interface may cause outdoor moisture and dust to enter into the transceiver enclosure housing, a more cautious approach is to connect the feed line through a coaxial cable to the bi-directional down converter 100. The bidirectional converter as part of a bi-directional MMDS transceiver can then be placed in an indoor environment.

Hemmie et al. specifically mentioned in U.S. Pat. No. 5,437,052 that the bi-directional converter 100 could be located in the support boom 86 and directly coupled to the feed 84 to eliminate the need of a coaxial connection 210 altogether similar to U.S. Pat. No. 5,202,699. As shown in FIGS. 2A and 2B from U.S. Pat. No. 5,202,699, a similar problem exits that there are feed lines 310 and 320 penetrate the housing of enclosure housing 220 and again presents the difficulties of vulnerable metal-penetration-to-plastic weak interface.

Therefore, a need still exists in the art of bi-directional MMDS transceiver to provide a new structure and assembling method to resolve these difficulties encountered in the prior art systems. An improved mechanical structure of the bi-directional MMDS transceiver must be able to integrate the antenna and the transceiver circuit as single body structure. Additional such structural configuration must be provided to complete seal the circuit by eliminating the metal-penetration-to-plastic vulnerable interface. A reliable module with minimal transmission loss would then be available for long term reliable outdoor operation. Meanwhile, it is desirable that the structure and configuration must also be able to simplify the assembly process for manufacturing the MMDS transceiver to reduce the production costs.

SUMMARY OF THE PRESENT INVENTION

It is therefore an object of the present invention to provide a novel structural configuration and methods for assembling an antenna-transceiver for a bi-directional MMDS transceiver by integrating the antenna together with a signal feed line connected to the transceiver circuits as a single-body structure to minimize the transmission loss. Meanwhile, such structure is provided with a direct dipole-to-enclosure housing interface with an O-ring seal such that the MMDS transceiver is suitable for long-term outdoor operation and the difficulties and limitations in the prior art can be overcome. Furthermore, the transceiver can also be easily characterized and assembled in the manufacturing process.

Specifically, it is an object of the present invention to provide a novel structural configuration and assembly method for the bi-directional MMDS antenna-transceiver. An integrated single-body antenna-transceiver assembly for a multi-channel multi-point distribution system (MMDS) transceiver for bi-directional signal transmission and reception is provided in this invention. The integrated single-body antenna-transceiver assembly is completely sealed with a waterproof outer layer with metal-to-metal interface sealed with a waterproof O-ring such that long-term outdoor operation can be sustained without degradation.

Another object of the present invention is to provide a novel structural configuration and assembly method for the bi-directional MMDS antenna-transceiver. An integrated single-body antenna-transceiver assembly is provided with two types of reflector mounting means corresponding with either horizontal or vertical signal polarization for several types of reflectors. The integrated single-body antenna-transceiver assembly is therefore serving as a reflector mounting base that can be universally employed by different users under different situations requiring the use of different types of reflectors.

Briefly, in a preferred embodiment, the present invention includes an integrated single-body antenna-transceiver assembly for a multi-channel multi-point distribution system (MMDS) transceiver for bi-directional signal transmission and reception. The assembly comprises a dipole antenna-body comprising a surrounded plastic-molded exterior with an internal metal dipole antenna extending vertically from a metal attachment-seat surrounding a signal feed pin connected to the dipole antenna. The assembly further comprises an MMDS transceiver having a transmitter printed circuit board (PCB) and a receiver PCB enclosed in a waterproof metal housing having an antenna-attachment pad including a signal feed pin opening. The dipole antenna-body is securely attached to the metal housing by attaching to the antenna-attachment pad sealed with an O-ring with the signal feed pin extended through the signal feed pin opening to contact the receiver PCB, the diplexer, and the transmitter PCB. In a preferred embodiment, waterproof metal housing for enclosing the transceiver further includes mounting means for securely mounting a reflector thereon. In another preferred embodiment, the waterproof metal housing for enclosing the transceiver further includes two types of mounting means corresponding with either horizontal or vertical signal polarization for several types of reflectors thereon.

These and other objects and advantages of the present invention will no doubt become obvious to those of ordinary skill in the art after having read the following detailed description of the preferred embodiment which is illustrated in the various drawing figures.

BRIEF DESCRIPTION OF THE DRAWINGS

FIGS. 7A and 7B are perspective views for showing the reflector mounting means for mounting backfire reflectors on the waterproof metal housing of the MMDS transceiver; and FIGS. 8A and 8B are perspective views for showing the reflector mounting means for mounting Yagi reflectors on the waterproof metal housing of the MMDS transceiver;

DETAILED DESCRIPTION OF THE PREFERRED EMBODIMENT

Figure 1:
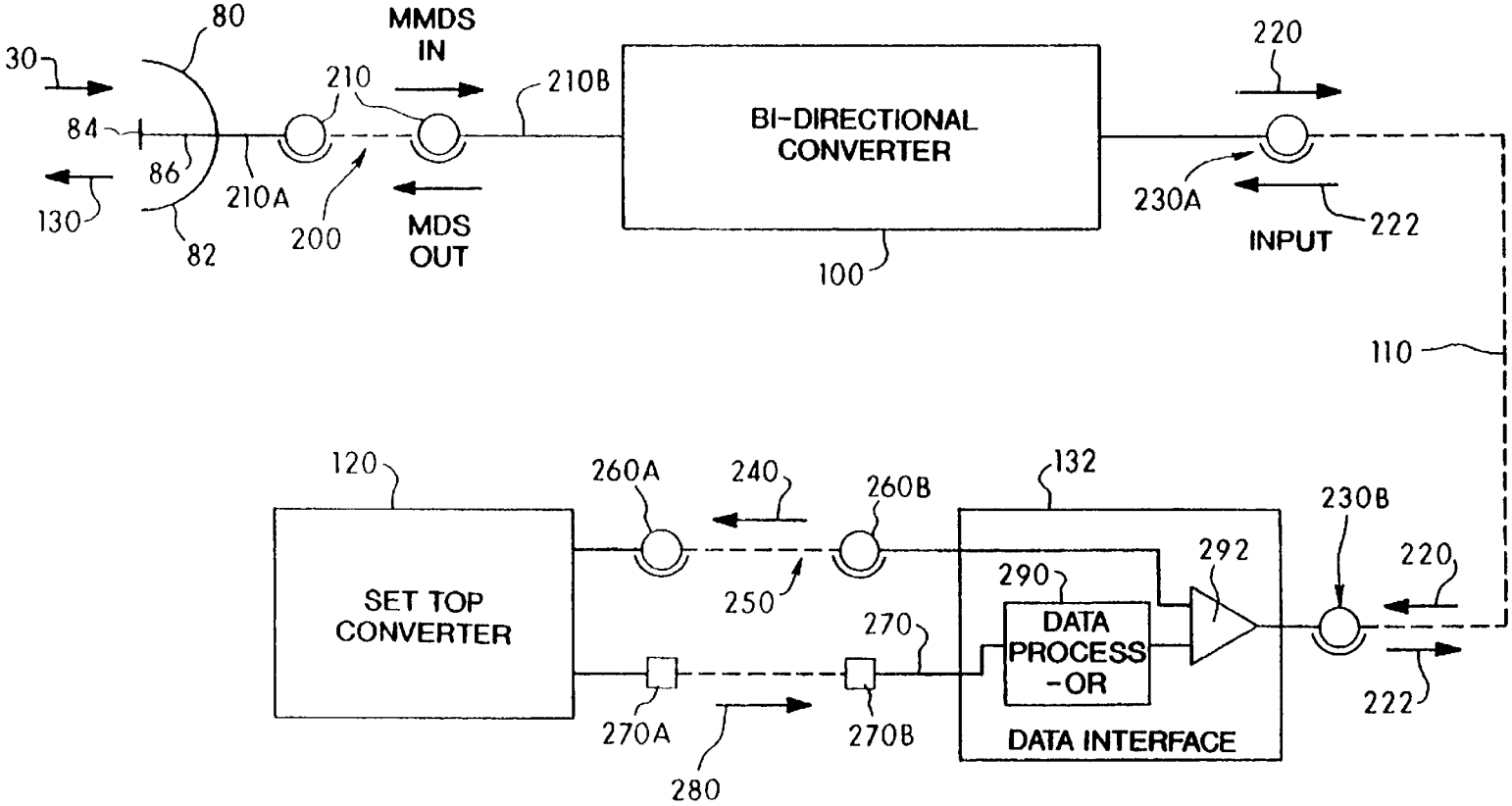
FIG. 1 (Prior Art)
FIG. 1 shows a functional block diagram of a transceiver according to a prior art Patent.
Figure 2A:
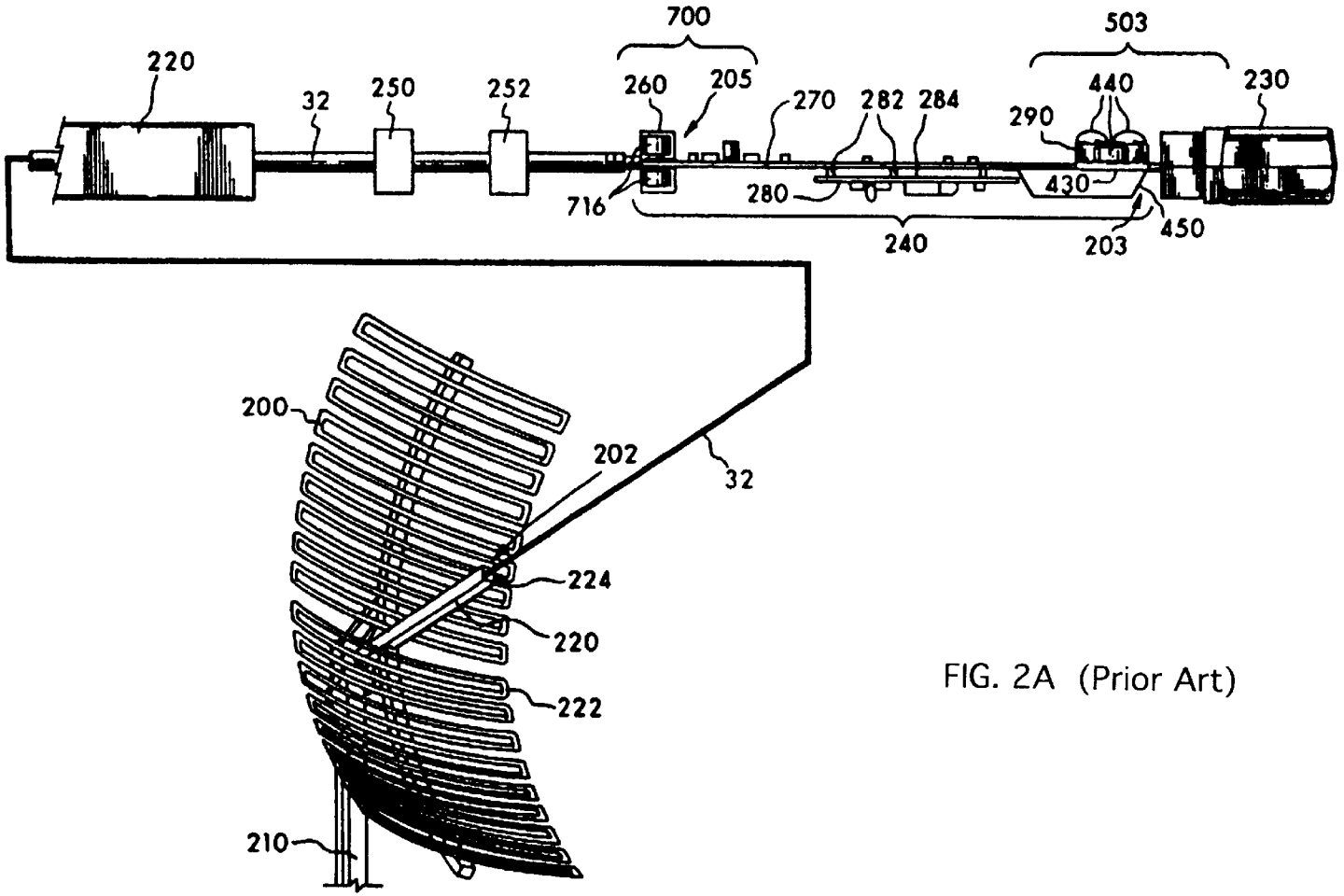
FIG. 2A (Prior Art)
FIGS. 2A and 2B are functional block diagrams of a down converter and the structure for integration according to another prior art Patent.
Figure 2B:
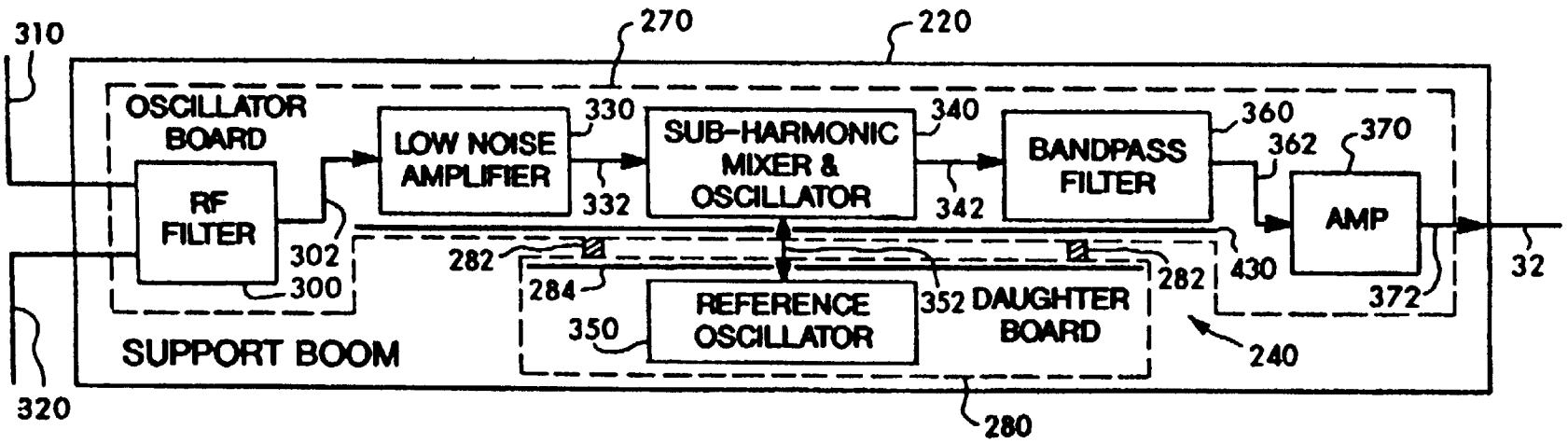
FIG. 2B (Prior Art)
Figure 3:
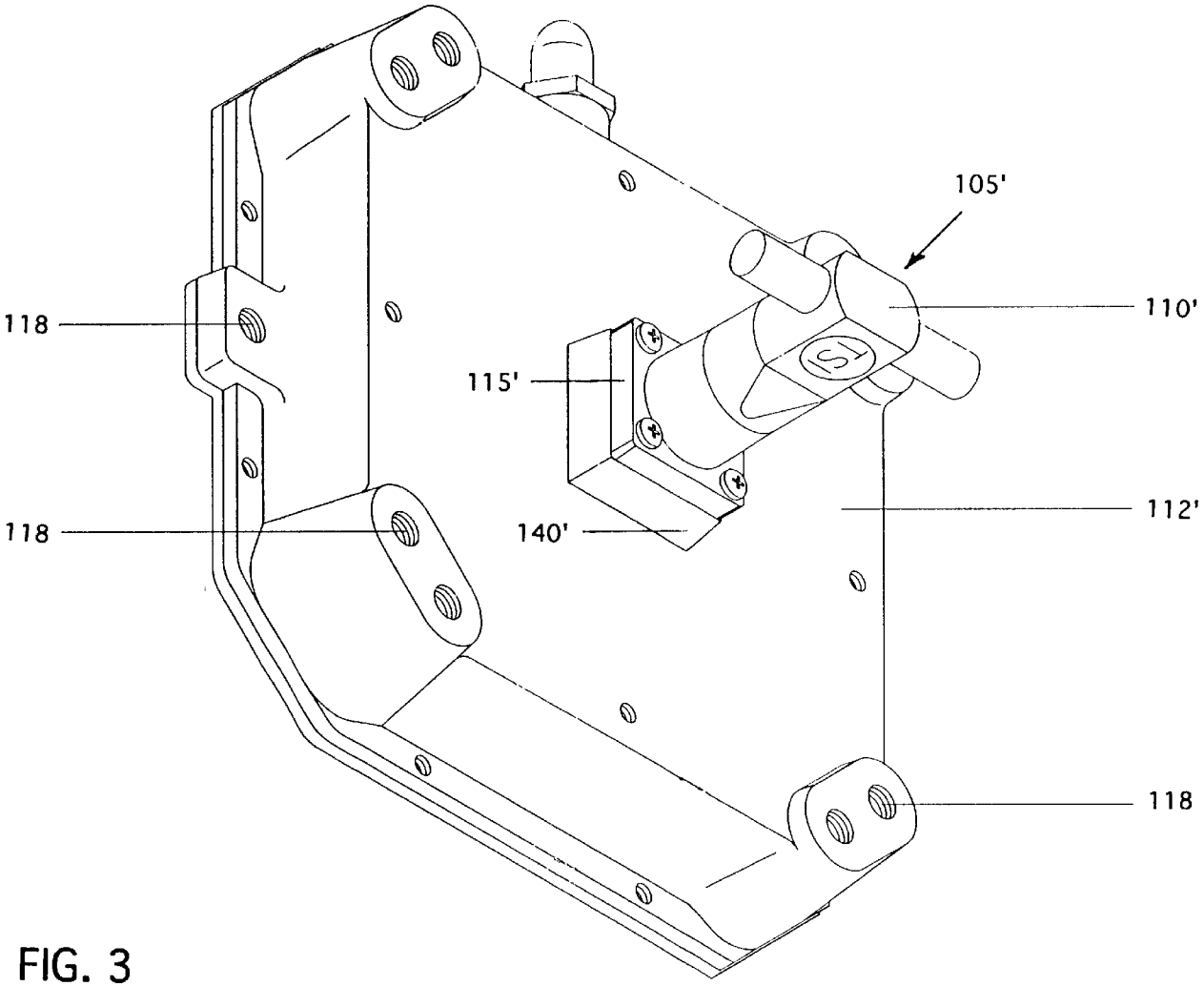
FIG. 3 is perspective view of single-body antenna-transceiver assembly for a multi-channel multi-point distribution system (MMDS) transceiver for bi-directional signal transmission and reception.
Figure 4:
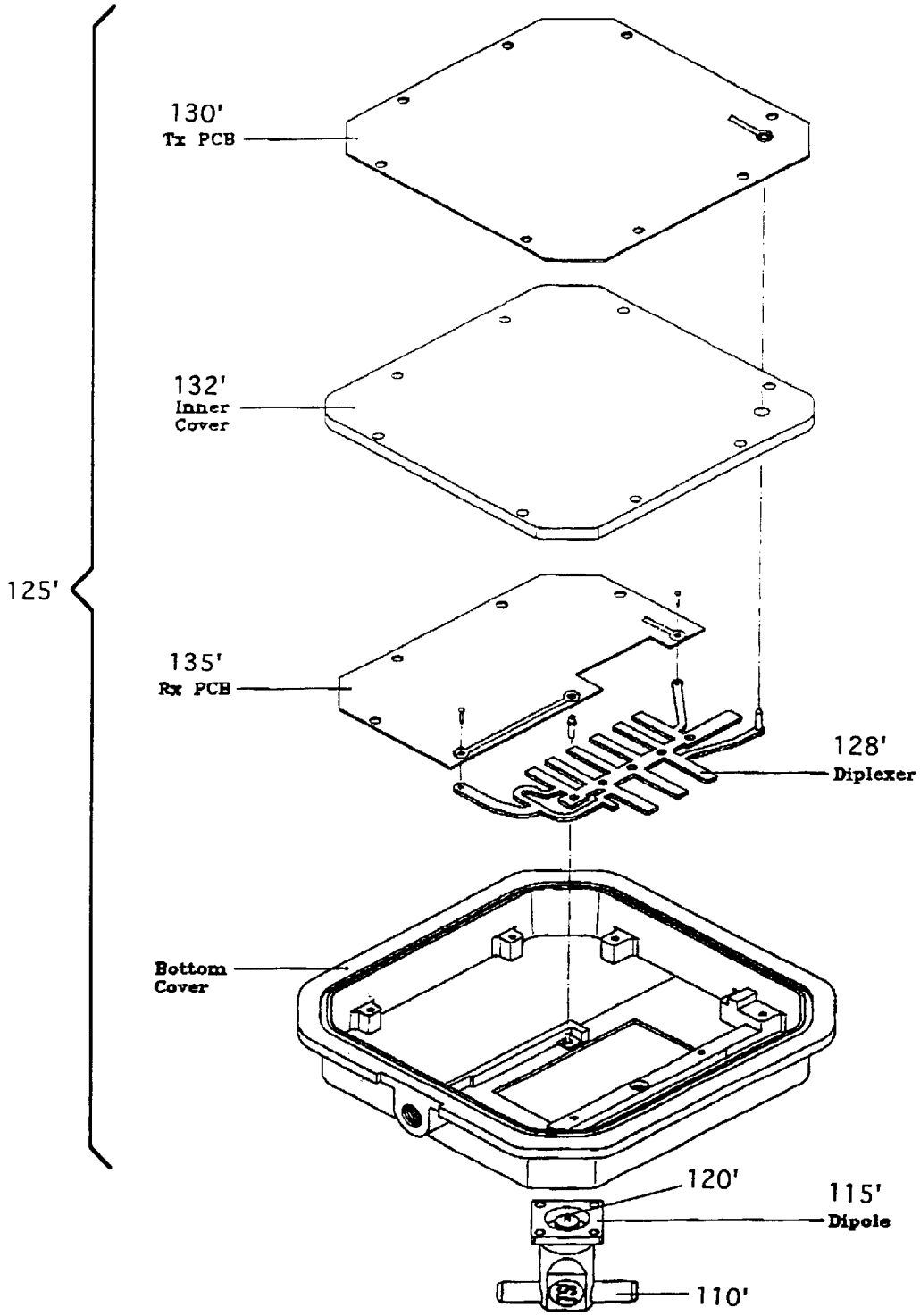
FIG. 4 is an exploded perspective view showing an MMDS transceiver enclosed in a waterproof metal housing with printed circuit boards contacting the signal feed pin of the dipole antenna.

Referring to FIG. 3 for a perspective view of a top portion of an integrated single-body antenna-transceiver assembly for a multichannel multi-point distribution system (MMDS) transceiver for bi-directional signal transmission and reception. The top portion includes a dipole antenna-body 105' comprising a surrounded plastic-molded exterior with an internal metal dipole antenna 110' extending vertically from a metal attachment-seat 115'. Referring to FIG. 4, the metal attachment-seat 115' surrounds a signal feed pin 120' connected to the dipole antenna 110'. The antenna-transceiver assembly further includes an MMDS transceiver 125' having a transmitter printed circuit board (PCB) 130' and a receiver PCB 135' enclosed in a waterproof metal housing 112' having an antenna-attachment pad 140' including a signal feed pin opening 145' (See FIG. 5A). An inner cover 132' is also placed between the transmitter PCB 130' and the receiver PCB 135'. The dipole antenna-body 105' is securely attached to the waterproof metal housing 112' by attaching to the antenna-attachment pad 140' sealed with an O-ring with the signal feed pin 120' extended through the signal feed pin opening 145' to contact the receiver PCB 135', the diplexer 128', and the transmitter PCB 130'.

Figure 5B:
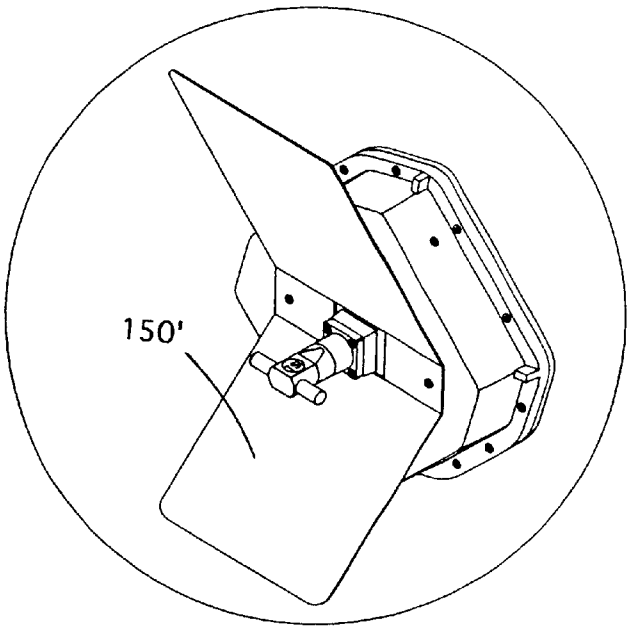
FIGS. 5A to 6B are perspective views for showing the reflector mounting means for mounting corner reflectors on the waterproof metal housing of the MMDS transceiver.
Figure 5A:
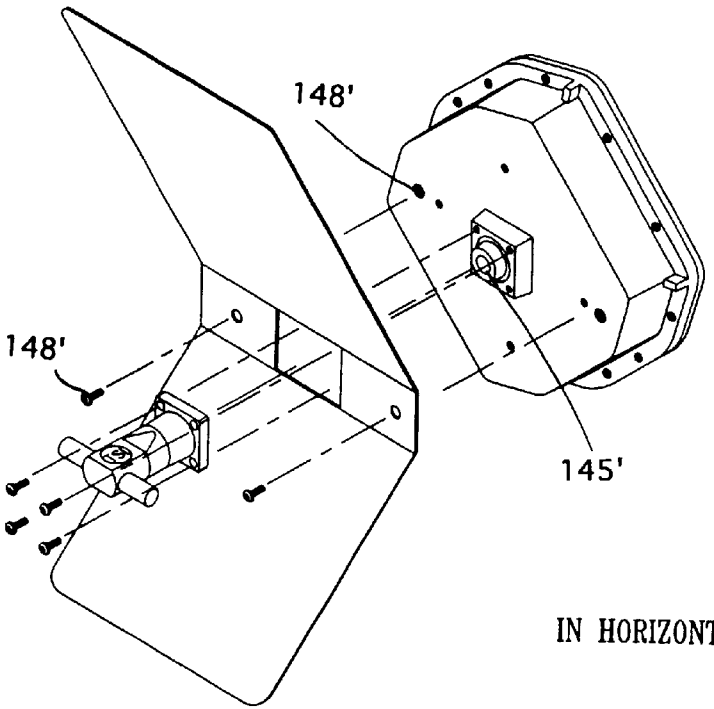
Figure 6B:
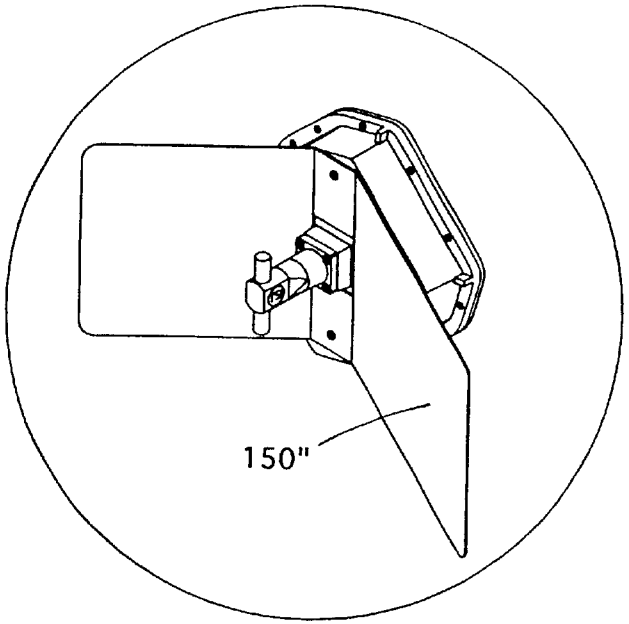
Figure 6A:
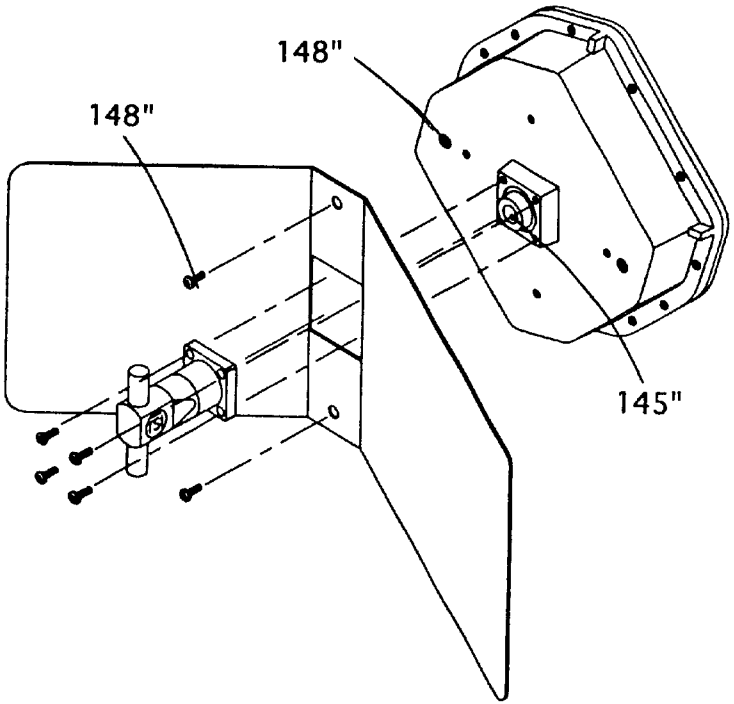

Referring to FIG. 3 and FIGS. 5A to 5B, the integrated single-body antenna-transceiver assembly further includes mounting means 148' provided on the transceiver waterproof metal housing 112' for securely mounting a reflector 150' thereon. As shown in FIGS. 6A, 6B, 7A, 7B and 8A and 8B, the integrated single-body antenna-transceiver assembly further includes two types of mounting means 148' and 148" corresponding with either horizontal or vertical signal polarization. These types of mounting means are provided on the transceiver waterproof metal housing 112' for compatibly mounting several types of reflectors, e.g., reflectors types 150', 150", 160', 160", 170', and 170" thereon. Specifically, a corner reflector 150' is mounted horizontally on the integrated single-body antenna-transceiver assembly as that shown in FIGS. 5A and 5B. A corner reflector 150" is mounted vertically on the integrated single-body antenna-transceiver assembly as that shown in FIGS. 6A and 6B. A backfire reflector 160' is mounted horizontally on the integrated single-body antenna-transceiver assembly as that shown in FIG. 7A. A backfire reflector 160" is mounted vertically on the integrated single-body antenna-transceiver assembly as that shown in FIG. 7B. A Yagi reflector 170' is mounted horizontally on the integrated single-body antenna-transceiver assembly as that shown in FIG. 8A. A Yagi reflector 170" is mounted vertically on the integrated single-body antenna-transceiver assembly as that shown in FIG. 8B.

In summary, this invention discloses an integrated single-body antenna-transceiver assembly for a multi-channel multi-point distribution system (MMDS) transceiver for bi-directional signal transmission and reception. The assembly comprises an antenna and a transceiver integrated as a single-body structure completely covered by an outer water-tight sealed layer. In a preferred embodiment, the antenna comprising a dipole antenna-body comprising a surrounded plastic-molded exterior with an internal metal dipole antenna extending vertically from a metal attachment-seat surrounding a signal feed pin connected to the dipole antenna. In another preferred embodiment, the transceiver comprising an MMDS transceiver having a transmitter printed circuit board (PCB) and a receiver PCB enclosed in a waterproof metal housing having an antenna-attachment pad including a signal feed pin opening. In another preferred embodiment, the dipole antenna-body is securely attached to the waterproof metal housing by attaching to the antenna-attachment pad sealed with an 0ring with the signal feed pin extended through the signal feed pin opening to contact the receiver PCB, the diplexer, and the transmitter PCB. In another preferred embodiment, the waterproofed metal housing for enclosing the transceiver further includes mounting means for securely mounting a reflector thereon. In another preferred embodiment, the waterproof metal housing for enclosing the transceiver further includes two types of mounting means corresponding with either horizontal or vertical signal polarization for several types of reflectors thereon.

This invention also discloses a method for manufacturing an integrated single-body antenna-transceiver assembly 100' for a multi-channel multi-point distribution system (MMDS) transceiver for bi-directional signal transmission and reception. The method comprises steps of: a) constructing a dipole antenna-body 105' by plastic-molding the exterior of a metal dipole antenna 110' and a metal attachment-seat 115' surrounding a signal feed pin 120' connected to the dipole antenna extending vertically from the attachment-seat 115'; b) enclosing an MMDS transceiver 125' having a transmitter printed circuit board (PCB) 130' and a receiver PCB 135' in a waterproof metal housing 112' having an antenna-attachment pad 140' including a signal feed pin opening; and c) securely attaching the dipole antenna-body 105' to the antenna-attachment pad 140' sealed with an O-ring with the signal feed pin 120' extended through the signal feed pin opening to contact the receiver PCB 135', the diplexer 128', and the transmitter PCB 130'. In a preferred embodiment, the step of enclosing the transceiver by the waterproof metal housing comprising a step of providing mounting means 148' on the waterproof metal housing for securely mounting a reflector thereon. In another preferred embodiment, the step of enclosing the transceiver by the waterproof metal housing further comprising a step of providing two types of mounting means 148' and 148" on the waterproofmetal housing 112' corresponding with either horizontal or vertical signal polarization for several types of reflectors thereon 150', 150", 160', 160", 170' and 170".

Therefore, this invention discloses a novel structural configuration and methods for assembling an antenna-transceiver for a bi-directional MMDS transceiver by integrating the antenna together with a signal feed line connected to the transceiver circuits as a single-body structure to minimize the transmission loss. Meanwhile, such structure is provided with the dipole-to-enclosure housing interface totally and securely sealed with O-ring such that the MMDS transceiver is suitable for long term outdoor operation and the difficulties and limitations in the prior art can be overcome. Specifically, an integrated single-body antenna-transceiver assembly for a multi-channel multipoint distribution system (MMDS) transceiver for bi-directional signal transmission and reception is provided in this invention. The integrated single-body antenna-transceiver assembly is completed sealed with a waterproof outer layer without any metal-penetration-to-plastic interface weak points such that long-term outdoor operation can be sustained without degradation. The integrated single-body antenna-transceiver assembly is also provided with reflector mounting means for mounting one type or several types of reflector. The integrated single-body antenna-transceiver assembly is therefore serving as a reflector-mounting base that can be universally employed by different users under different situations requiring the use of different types of reflectors.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An integrated single-body antenna-transceiver assembly for a multi-channel multi-point distribution system (MMDS) transceiver for bi-directional signal transmission and reception comprising:

a dipole antenna-body comprising a plastic-molded exterior with an internal metal dipole antenna extending vertically from a metal attachment-seat surrounding a signal feed pin connected to said dipole antenna;

an MMDS transceiver having a transmitter printed circuit board (PCB) and a receiver PCB enclosed in a waterproof metal housing having an antenna-attachment pad including a signal feed pin opening; and said dipole antenna-body is securely attached to said waterproof metal housing by attaching to said antenna-attachment pad sealed with an O-ring with said signal feed pin extended through said signal feed pin opening to direct contact said receiver PCB, a diplexer, and said transmitter PCB for direct signal reception and transmission communications within said single-body structure.

2. The integrated single-body antenna-transceiver assembly of claim 1 wherein:

said metal housing for enclosing said transceiver further includes mounting means for securely mounting a reflector thereon surrounding said dipole antenna-body.

3. The integrated single-body antenna-transceiver assembly of claim 1 wherein:

said metal housing for enclosing said transceiver further includes two types of mounting means corresponding with either horizontal or vertical signal polarization for mounting several types of reflectors thereon surrounding said dipole antenna-body.

4. The integrated single-body antenna-transceiver assembly of claim 2 wherein:

said metal housing for enclosing said transceiver further includes mounting means for securely mounting a corner reflector thereon surrounding said dipole antenna-body.

5. The integrated single-body antenna-transceiver assembly of claim 2 wherein:

said metal housing for enclosing said transceiver further includes mounting means for securely mounting a backfire reflector surrounding said dipole antenna-body.

6. The integrated single-body antenna-transceiver assembly of claim 2 wherein:

said metal housing for enclosing said transceiver further includes mounting means provided for securely mounting a Yagi reflector thereon.

7. The integrated single-body antenna-transceiver assembly of claim 3 wherein:

said metal housing for enclosing said transceiver further includes mounting means provided for compatibly mounting a corner reflector and a backfire reflector thereon.

8. The integrated single-body antenna-transceiver assembly of claim 3 wherein:

said metal housing for enclosing said transceiver further includes mounting means provided for compatibly mounting a corner reflector, a backfire reflector and a Yagi reflector thereon.

9. An integrated single-body antenna-transceiver assembly for a multi-channel multi-point distribution system (MMDS) transceiver for bi-directional signal transmission and reception comprising:

an antenna protected by a plastic-molded exterior-layer and a transceiver enclosed in a completely water-tight sealed container wherein said antenna and said transceiver integrated as a single-body structure with said antenna mounted onto said container.

10. The integrated single-body antenna-transceiver assembly of claim 9 wherein:

said antenna comprising a dipole antenna-body completely covered by a plastic-molded exterior with an internal metal dipole antenna extending vertically from a metal attachment-seat surrounding a signal feed pin connected to said dipole antenna.

11. The integrated single-body antenna-transceiver assembly of claim 10 wherein:

said transceiver comprising an MMDS transceiver having a transmitter printed circuit board (PCB) and a receiver PCB enclosed in said water-tight sealed container having an antenna-attachment pad including a signal feed pin opening.

12. The integrated single-body antenna-transceiver assembly of claim 11 wherein:

said dipole antenna-body is securely attached to said water-tight sealed container by attaching to said antenna-attachment pad sealed with an O-ring with said signal feed pin extended through said signal feed pin opening to directly contact said receiver PCB, a diplexer, and said transmitter PCB.

13. The integrated single-body antenna-transceiver assembly of claim 1 wherein:

said metal housing for enclosing said transceiver further includes mounting means provided for securely mounting a reflector thereon surrounding said dipole antenna-body.

14. The integrated single-body antenna-transceiver assembly of claim 11 wherein:

said metal housing for enclosing said transceiver further includes two types of mounting means corresponding with a horizontal and a vertical signal polarization provided for mounting several types of reflectors thereon.

15. A method for manufacturing an integrated single-body antenna-transceiver assembly for a multi-channel multi-point distribution system (MMDS) transceiver for bi-directional signal transmission and reception comprising:

a) forming a dipole antenna-body by plastic-molding an exterior of a metal dipole antenna and an attachment seat surrounding a signal feed pin connected to said dipole antenna with said dipole antenna extending vertically from said attachment-seat;

b) enclosing an MMDS transceiver having a transmitter printed circuit board (PCB) and a receiver PCB in a waterproof metal housing having an antenna-attachment pad including a signal feed pin opening; and c) securely attaching said dipole-antenna body to said antenna-attachment pad sealed with an O-ring with said signal feed pin extended through said signal feed pin opening to directly contact said receiver PCB, a diplexer, and said transmitter PCB.

16. The method of claim 15 wherein:

said step of enclosing said transceiver by said metal housing further comprising a step of providing a mounting means on said waterproof metal housing for securely mounting a reflector thereon surrounding said dipole antenna-body.

17. The method of claim 15 wherein:

said step of enclosing said transceiver by said metal housing further comprising a step of providing two types of mounting means on said waterproof metal housing corresponding with a horizontal and a vertical signal polarization provided for mounting several types of reflectors thereon.

18. The method of claim 16 wherein:

said step of providing a mounting means on said metal housing comprising a step of providing a mounting means for securely mounting a corner reflector thereon surrounding said dipole antenna-body.

19. The method of claim 16 wherein:

said step of providing a mounting means on said metal housing comprising a step of providing a mounting means for securely mounting a backfire reflector thereon surrounding said dipole antenna-body.

20. The method of claim 16 wherein:

said step of providing a mounting means on said metal housing comprising a step of providing a mounting means for securely mounting a Yagi reflector thereon surrounding said dipole antenna-body.

21. The method of claim 17 wherein:

said step of providing at least two types of mounting means on said metal housing comprising a step of providing a first type mounting means for securely mounting a corner reflector and a second mounting means for alternately mounting a backfire reflector thereon.

22. The method of claim 17 wherein:

said step of providing two types of mounting means corresponding with a horizontal and a vertical signal polarization on said metal housing for several types of reflector comprising a step of providing first mounting means for securely mounting a corner reflector and a second mounting means for alternately mounting a backfire reflector and a Yagi reflector thereon.

23. A method for manufacturing an integrated single-body antenna-transceiver assembly for a multi-channel multi-point distribution system (MMDS) transceiver for bi-directional signal transmission and reception comprising:

manufacturing and integrating an antenna and a transceiver as a single-body structure with signal communication within said single-body structure and completely covering said single-body structure by an outer water-tight completely sealed layer.

24. The method of claim 23 wherein:

said step of manufacturing an antenna comprising a step of protecting a dipole antenna-body by a plastic-molding exterior with an internal metal dipole antenna and an attachment-seat surrounding a signal feed pin connected to said dipole antenna with said dipole antenna extending from said attachment-seat to said transceiver to provide said signal communication within said single-body structure.

25. The method of claim 24 wherein:

said step of manufacturing said transceiver comprising a step of enclosing a transmitter printed circuit board (PCB) and a receiver PCB in a waterproof metal housing having an antenna-attachment pad including a signal feed pin opening.

26. The method of claim 25 wherein:

said step of integrating said antenna and said transceiver further comprising a step of securely attaching said dipole antenna-body to said antenna-attachment pad sealed with an O-ring with said signal feed pin extended through said signal feed pin opening to direct contact said receiver PCB, a diplexer, and said transmitter PCB.

27. The method of claim 24 wherein:

said step of enclosing said transceiver in said waterproof metal housing further includes a step of providing a mounting means on said waterproof metal housing for securely mounting a reflector thereon surrounding said dipole antenna-body.

28. The method of claim 24 wherein:

said step of enclosing said transceiver in said waterproof metal housing further includes a step of providing two types of mounting means on said waterproof metal housing for alternately mounting at least two types of reflectors thereon.

* * * * *